United States Patent [19]

Kishida et al.

[11] Patent Number: 4,640,118

[45] Date of Patent: Feb. 3, 1987

[54] METHOD OF AND APPARATUS FOR MEASURING PILE SKIN FRICTION

[75] Inventors: Takao Kishida; Takeo Fukaya, both of Yokohama, Japan

[73] Assignee: Toa Harbor Works, Co., Ltd., Tokyo, Japan

[21] Appl. No.: 768,085

[22] Filed: Aug. 21, 1985

[30] Foreign Application Priority Data

Aug. 23, 1984 [JP] Japan ..... 59-174052

[51] Int. Cl.[4] ..... G01N 19/02

[52] U.S. Cl. ..... 73/9

[58] Field of Search ..... 73/9, 151, 84, 7; 175/402

[56] References Cited

U.S. PATENT DOCUMENTS

| | | | |
|---|---|---|---|
| 860,115 | 7/1907 | Baker | 175/402 |
| 2,713,791 | 7/1955 | Stewart et al. | 73/9 X |
| 2,779,187 | 1/1957 | Stewart | 73/9 |
| 2,972,881 | 2/1961 | Koch | 73/9 |
| 3,120,122 | 2/1964 | Kokesh | 73/9 X |
| 3,894,588 | 7/1975 | Brill | 73/9 X |
| 4,400,970 | 8/1983 | Ali | 73/9 |

FOREIGN PATENT DOCUMENTS

| | | | |
|---|---|---|---|
| 2538885 | 3/1977 | Fed. Rep. of Germany | 73/9 |
| 42793 | 4/1977 | Japan | 73/9 |
| 156312 | 12/1981 | Japan | 73/84 |
| 593088 | 2/1978 | U.S.S.R. | 73/9 |
| 905747 | 2/1982 | U.S.S.R. | 73/9 |

*Primary Examiner*—Stewart J. Levy
*Assistant Examiner*—Tom Noland
*Attorney, Agent, or Firm*—Armstrong, Nikaido, Marmelstein & Kubovcik

[57] ABSTRACT

Measurement of the skin friction of piles, according to which a skin-friction measuring device having a cylindrical testing part which is rotatable relative to a main body of the device is introduced into a bored hole in a ground and is rotated by a boring rod, and by rotating the boring rod, the friction force then generated between the cylindrical testing part and the wall of the bored hole is determined in terms of the torque required for rotating the cylindrical testing part.

9 Claims, 5 Drawing Figures

METHOD OF AND APPARATUS FOR MEASURING PILE SKIN FRICTION

BACKGROUND

The present invention relates to a method and apparatus for measuring the skin friction of foundation piles, which is for determining a dimensional and configurational specification for piles for supporting the intended structure.

The bearing capacity of foundation piles comprises two components, a point resistance and a skin friction. The point resistance represents the bearing capacity exhibited at the lower end of a pile placed in a ground against a force in the axial direction of the pile. The skin friction representing the bearing capacity against frictional resistance between soil or ground and the pile, along the pile shaft. In designing a structure to be built on foundation piles and to design the pile configuration economically and safely, it is extremely important to evaluate the point resistance and the skin friction, at the building site to appropriately evaluate of the bearing capacity of the foundation piles.

In the art of geotechnical engineering, how to appropriately evaluate the bearing capacity of piles is an important subject. There have been a variety of studies made, seeking to give a satisfactory solution to this subject. However, there has not yet been established a method which is relatively simple by which the bearing capacity of piles, particularly the skin friction thereof, can be determined with a high degree of accuracy.

In determining skin friction, it is generally practiced to determine the soil constant of the ground at the intended construction site and calculate the skin friction based on the determined soil constant. For determining soil constants, N values (blow counts found by the standard penetration test according to JIS A 1219) and qu values (unconfined compressive strength values found according to JIS A 1216) are employed. However, the N value represents soil characteristic parameter under a dynamic condition which is essential difference from skin friction which is a shear strength under a static condition. Thus, the qu value, represents the shear strength of soil under an undisturbed condition. However, when subjected to driving-in of a pile, the soil becomes disturbed. Its property undergoes a change.

Therefore, by any of today methods of determining the skin friction based on N values or qu values, it is infeasible to attain a satisfactory accuracy in the determination. Further, whereas in order to evaluate the skin friction accurately it is necessary to take into consideration each of the degree of disturbance which soil has undergone as a result of driving of a pile thereinto, the degree to which the soil restores its original condition as time lapses, and the influence on the friction resistance by a difference in the surface roughness of piles. These factors cannot be taken into account according to the evaluation methods making use of N values or qu values. Therefore, according to present evaluation methods, such methods often tends to result in under-evaluating skin friction and, in designing piles, placing more stress than necessary on safety.

A further known method of measuring the skin friction of piles comprises a loading test method according to ASTM D3966. Under this method, a load is applied on a pile driven in a ground. Determination is then made of displacement in the axial direction of the pile to evaluate skin friction. This test method can provide a bearing capacity value of the pile itself and is therefore advantageous in the light of the accuracy. However, such a load method involves the need of a large scale installation and is costly and time-consuming to operate. In practice it is extremely difficult to operate the load test method frequently. Generally, the load test method is terminated as soon as the design bearing capacity is reached. Thus, it is likely, even in the case of this test method, that the determination of the skin friction lacks accuracy. Thus, the design bearing capacity are usually conservatively set.

SUMMARY

It is a primary object of the present invention to overcome the difficulties in the prior art methods of evaluation of the skin friction of foundation piles.

It also is an object of the invention to provide a method and apparatus for determining the skin friction of foundation piles at a high accuracy without the need of operating a costly and time-consuming loading test.

To attain these and other objects, which will become more apparent as the description proceeds, the method of the invention broadly comprises the steps of forming a bored hole in the ground, placing a cylindrical testing part of a skin-friction measuring apparatus into the bored hole, rotating the testing part and finding the torque required for the rotating of the testing part. The apparatus of the invention broadly comprises a cylindrical testing part rotatably mounted on a main body in a manner so as to be exposed about the peripheral face of the main body, a boring rod for rotating the cylindrical testing part and a measuring device for measuring the required torque for rotating the testing part.

While the skin friction of piles is influenced by many factors, such as, the degree of soil disturbance induced by a pile driving, the degree of restoration of shear strength of soil after the pile driving, and so forth, these factors are, to a certain extent, simulated in the case of the present invention. Thus, the evaluation of the skin friction can be made at a considerably higher accuracy according to the present invention than according to conventional evaluation methods.

These and other features and advantages of the invention will be clearly seen from the following description of the preferred embodiments of the invention, taken in conjunction with the accompanying drawings.

THE DRAWINGS

THE PREFERRED EMBODIMENTS

The present invention will be described in greater detail with reference to the accompanying drawings.

Figure 1:
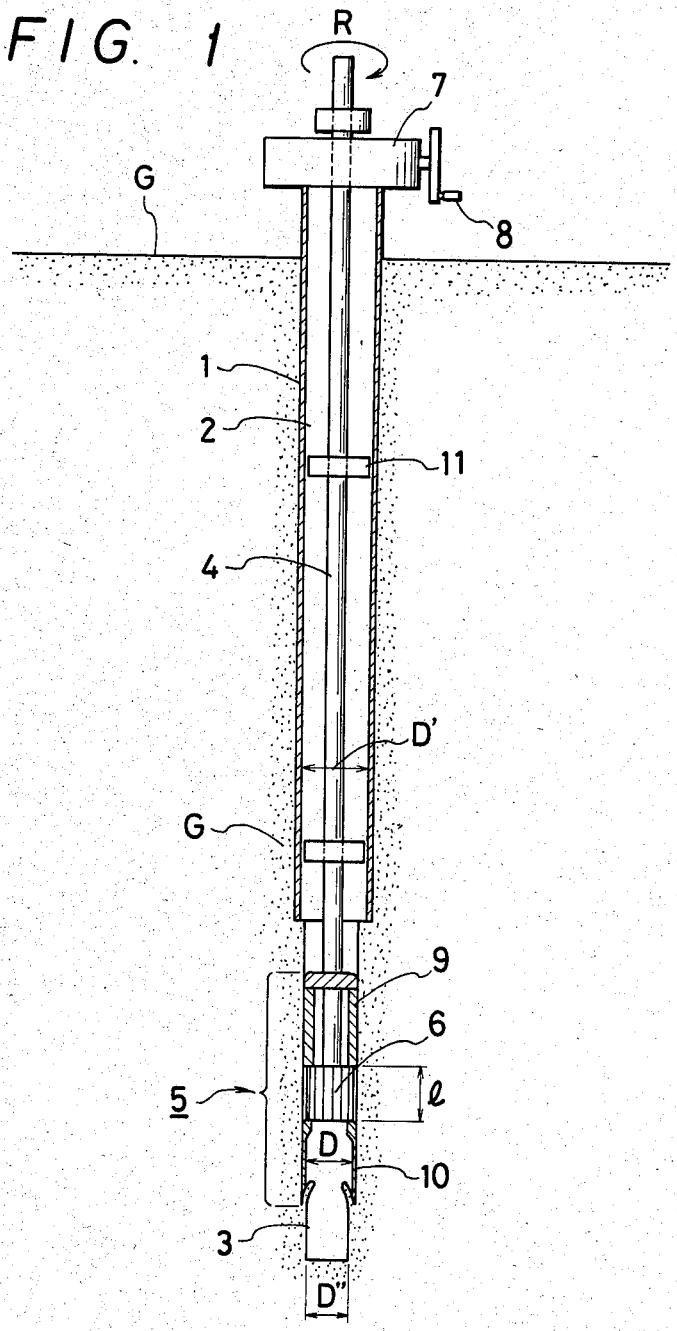
FIG. 1 is a longitudinal sectional view, taken for an illustration of the method embodying the present invention.

As can best be seen in FIG. 1, according to the method of the invention, hole 2 is drilled in ground G to the prescribed depth, with casing pipe 1. A hole 3 is then bored through the bottom of the hole 2. The diameter of hole 3 is smaller than that of the hole 2 and smaller than the diameter of a measuring device 5 later to be described. The measuring device 5, which is provided at a lower or leading end portion of a boring rod 4, is introduced into the hole 3. By operating measuring means which, in the illustrated embodiment, comprises a handle 8, of a turning device 7 equipped with a torque measuring member, a cylindrical testing part 6 rotatably mounted in measuring device 5 is rotated by boring rod 4, and the torque required for rotating the testing part 6 is measured.

The above-mentioned measuring device 5 measures the skin friction of piles and comprises a main body 9 supported at a lower or leading end portion of the boring rod 4, a driving shoe 10 mounted to the lower or leading end of the main body 9, and the cylindrical testing part 6, which has a length l and is disposed above the driving shoe 10 and exposed about the peripheral face of the main body 9.

According to the method of the invention, which is performed with the apparatus, the main body 9 is inserted into the bored hole 3 by the boring rod 4. The main body 9 and the driving shoe 10 are non-rotational members, while the cylindrical testing part 6 is rotatable relative to the main body 9. Thus, it is feasible to rotate the testing part 6 is rotated alone, through the boring rod 4 when test part 6 is located at the prescribed depth in the ground G. The boring rod 4 is rotatably supported by guide rollers 11 disposed at a central portion inside of the casing pipe 1. Therefore, the torque required for turning or rotating the testing part 6 fixed at a leading end portion of the boring rod 4 is transmitted to the loading device 7.

Now, with the reference transferred to FIG. 2, the measuring device 5 will be described in greater detail.

Figures 2, 3:
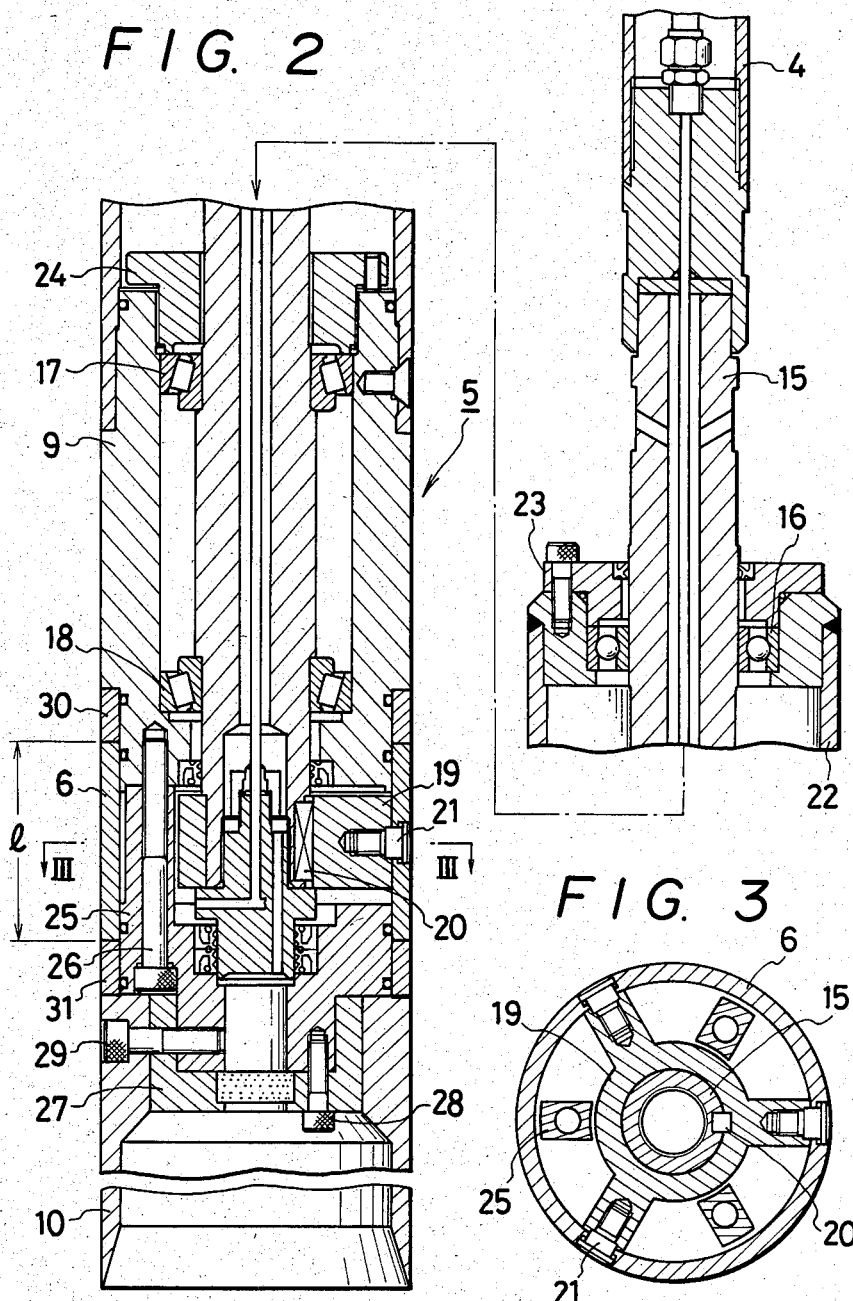
FIG. 2 is also a longitudinal section, showing essential parts of the apparatus embodying the present invention.
FIG. 3 shows a cross-sectional view, taken on line III—III in FIG. 2.

In the main body 9 FIG. 2, a shaft 15 connected to the leading end of the boring rod 4 is rotatably supported by bearings 16, 17 and 18. At the bottom end of the shaft 15, a support member 19 is fixed, by a key 20, to shaft 15. Thus, the support member 19 is prevented from being rotated. Externally about support member 19, cylindrical testing part 6 is removably secured by bolts 21. At an upper portion of the main body 9, a cylinder 22, having its upper end closed by a cover member 23, is removably mounted. Bearing 17, which is a thrust bearing, is pressed down by a holding metal member 24 screwed in an upper end of the main body 9. Connecting member 25 is fixed by bolt 26 to a lower end portion of the main body 9. Cap member 27 is fixed by a bolt 28 to the lower end of connecting member 25. Shoe, 10 is secured to the connecting member 25 by a bolt 29 through the cap member 27.

The apparatus of the invention is operated as follows:

The force for driving the device 5 into bored hole 3 for measuring the skin friction is transmitted to the shoe 10 through the boring rod 4 via the shaft 15, bearing or thrust bearing 18, and the connecting member 25. As the driving shoe 10 is operated to shave or chip the wall of the hole 3 to increase the diameter thereof, the measuring device 5 is advanced deeper into the ground G. While the main body 9, the cylinder 22 and the driving shoe 10 are held in position in the ground G, the cylindrical testing part 6 is rotated by the boring rod 4.

It will be readily understood that it is advantageous to provide a plurality of cylindrical testing part 6 different in surface roughness. The testing part 6 is replaced with another testing part in a manner as follows: First, the bolt 29 is removed, so that the driving shoe 10, fixed to the connecting member 25, can be removed. Then, by removing the bolt 21, the testing part 6 fixed to the support member 19 is removed together with spacers 30 and 31, and can be replaced with a different part 6. The surface roughness of the cylindrical testing part 6 to be used for testing can be selected by taking into consideration the property or characteristic of the ground G, the material of the pile to be designed, and so forth.

In FIG. 2, the cylindrical testing part 6 has a length l between upper and lower spacers 30 and 31 therefor, but these spacers may be dispensed with by so designing the part 6 as to have a length greater than the length l by the difference corresponding to the length or depth of the spacers 30 and 31.

Figure 4:
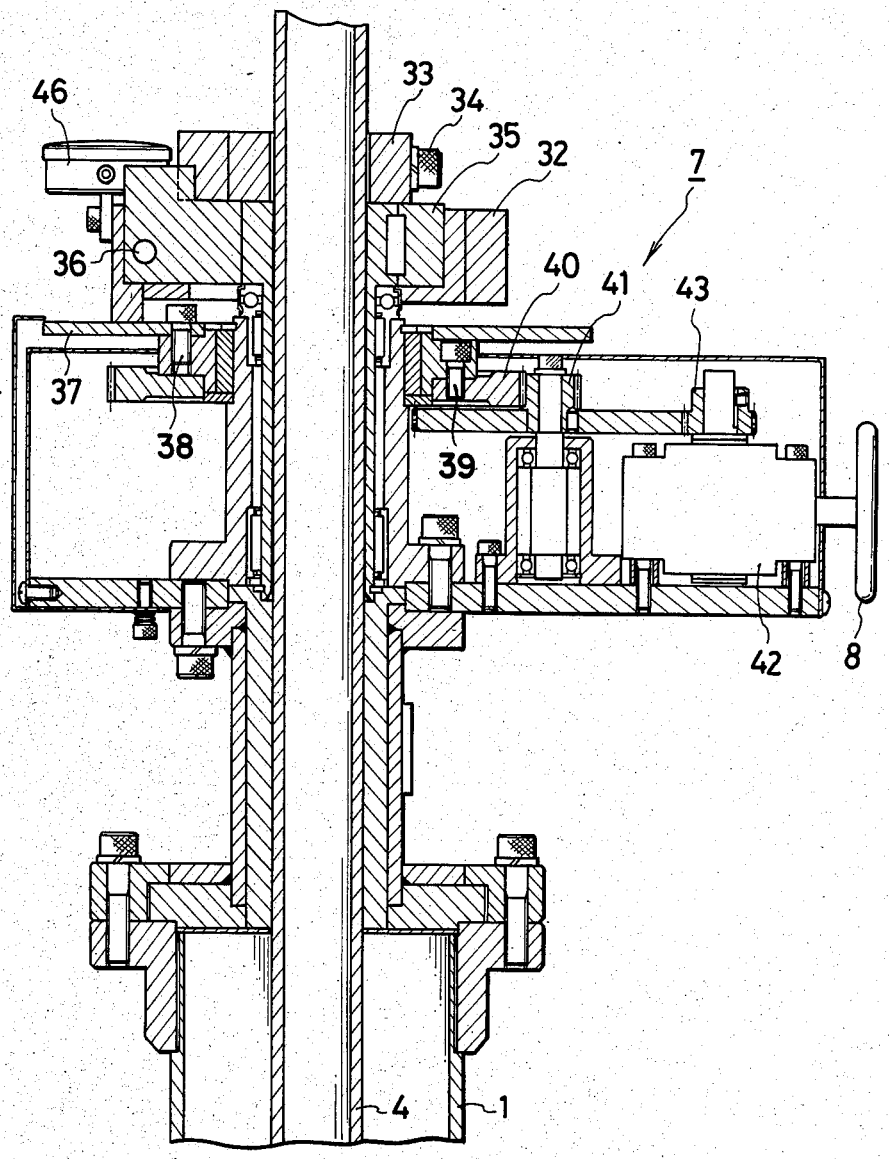
FIG. 4 is a longitudinal sectional view, showing essential parts of a torque measuring device in the apparatus of the invention.
Figure 5:
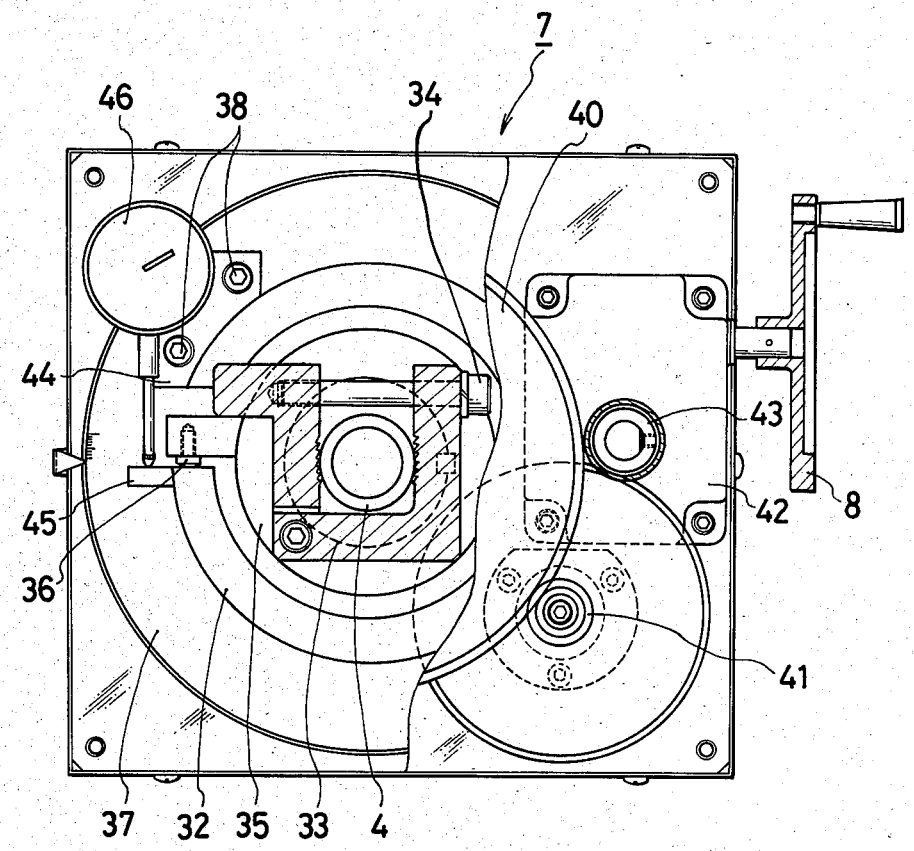
FIG. 5 is a plan view of essential parts of the torque measuring device.

The loading device 7 provided with a torque measuring member is for rotating the cylindrical testing part 6 and for measuring the torque required for the rotating of the testing part 6, and is illustrated in FIGS. 4 and 5.

As shown, the loading device 7 includes a support member 33, secured to an upper end portion of the boring rod 4 by a bolt 34 so as to be rotatable with the rod 4. Another support member 35 is disposed below the support member 33 partly in contact with member 33. The support member 35 is rotatable together with the boring rod 4. A torque measuring spring 32 is mounted external to the support member 35, and is in contact with the head of a bolt 36 secured to the support member 35. Spring 32 is secured by a bolt 38 to a rotatory angle finding plate 37, which in turn is fixed by a bolt 39 to a gear 40 to mesh with a gear 41 and a gear 43 on the side of a reduction gear 42, to which the handle 8 is connected.

In operation, the handle 8 is operated to rotate gears 43, 41 and 40 through the reduction gear 42. Torque measuring spring 32 fixed to the angle finding plate 37 is thus rotated, resulting in rotation of the boring rod 4 through the support members 35 and 33.

Upon the above operation, displacement, corresponding to the torque, occurs between a fixing end 44 and a contact plate 45 which form parts of the spring 32. The torque is measured by a strain gauge 46.

With use of the apparatus of the present invention, measurement of the skin friction of a foundation pile is carried out as follows:

First, casing pipe 1 is drilled into ground G to bring its lower or leading end to the prescribed depth in the ground G. A hole 3 having a smaller diameter than the measuring device 5 is then drilled below the lower end of the casing pipe 1. Thereafter, the device 5 mounted at a lower end portion of the boring rod 4 is driven into the prescribed depth into the ground. In such driving of the device 5, while the wall of the bored hole 3 is shaved by the driving shoe 10, the shaved-off mass of soil is received inside the shoe 10. In the above setting of the apparatus into the ground G no influence is exerted on the strength of the ground G or on the intended measurement of the skin friction.

With the apparatus set at the level to be measured, the handle 8 of the loading device 7 mounted on the upper end of the casing pipe 1 is rotated in the direction shown by R in FIG. 1 to rotate the cylindrical testing part 6. The part 6 has an outside diameter D smaller than the inside diameter D′ of the casing pipe 1 but larger than the diameter D″ of the bore 3. The dimensional relationship among these diameters D, D′ and D″ is determined taking into consideration that the inside diameter D′ of the casing pipe 1 should be such as to permit the skin-friction measuring device 5 to pass through the casing pipe 1 and that the diameter D'' of the bore 3 should be such that after a wall portion of the bored hole 3 is shaved or chipped by the driving shoe 10, as prescribed, the peripheral surface of the cylindrical testing part 6 is in close contact with the wall of the hole 3.

According to the present invention, not only the torque M required for the rotation of the testing part 6 but also the angle of rotation are measured by the measuring member or instrument attached to the loading device 7. The skin frictional stress, $\tau$, is calculated according to the following equation:

$$\tau = \frac{M}{\pi(D^2/2 \times l)}$$

wherein D is the outside diameter of the cylindrical testing part 6 and l is the length of the device 6.

With use of $\tau$ values obtainable as above, determination can be advantageously made of such as the length, diameter and material of foundation piles.

The following Table is entered for a comparison of skin friction values found according to (a) the method of the present invention for a first thing, (b) the loading test method for a second thing, and (c) the calculation method based on soil constants (N values or qu values), in connection with three piles A-1, A-2 and A-3 for respective measuring methods above.

TABLE

| | Skin Friction | | |
|---|---|---|---|
| Pile No. | Method (a) | Method (b) | Method (c) |
| A-1 | $220^{tf}$ | $195^{tf}$ | $104^{tf}$ |
| A-2 | 160 | 160 | 83 |
| A-3 | 315 | 280 | 158 |

As seen from the above Table, the skin friction values determined according to the today practiced calculation method based on soil constants [Method (c)] are all considerably lower than those determined by each of the Methods (a) and (b). There is a close correspondence between the values determined according to the present invention [Method (a)] and those determined by the loading test method [Method (b)]. Therefore it is seen that the measurement method according to the invention can provide skin friction values at a high accuracy and is advantageous from practical points of view.

As described in detail above, the present invention is advantageous in respect of the following.

The invention does not require any large scale installation. Therefore it can be readily applied in ordinally or routine soil investigations.

Also, because the cylindrical testing parts of different surface roughness conditions are interchangeable according to the invention, it advantageously is feasible to evaluate the effect of a change in the surface roughness of piles on the skin friction.

Further, the cylindrical testing part being so structured as to be rotatable, it is feasible to determine not only the skin frictional stress values ($\tau$) but also the angle of rotation. Therefore, it is possible to evaluate stress-strain characteristics between the piles and soil or ground.

Moreover, the measurement apparatus of the invention is designed to withstand hammering, so that it can be effectively utilized in connection with hard soil such as Pleistocene soil and even Tertiary soft rock.

We claim:

1. A method of measuring the skin friction of a pile, comprising the steps of drilling a hole into the ground, inserting a casing pipe in said hole, then forming a bored hole below the leading end of the casing pipe, introducing a skin-friction measuring device having a cylindrical testing part in contact with the wall of said bored hole into the above formed bored hole, rotating said cylindrical testing part of said skin-friction measuring device with a boring rod connected to said cylindrical testing part and extending upward through said casing pipe and out the upper end thereof, and determining the friction force generated between said cylindrical testing part and said wall of said bored hole in the ground by the torque required for the rotations of said cylindrical testing part.

2. A method as claimed in claim 1, wherein said bored hole is formed to have a diameter smaller than the diameter of a driving shoe at the leading end of said skin-friction measuring device so that said driving shoe forms in said bored hole as said driving shoe is driven into said bored hole an exposed wall for carrying out an accurate measurement of the skin friction.

3. A method as claimed in claim 1, wherein said cylindrical testing part is rotated at a location above the bottom of said bored hole.

4. Apparatus for measuring the skin friction of a pile hole, comprising: a main body, a cylindrical testing part rotatably mounted in a central portion on said main body for contact with the wall of a bored hole, a boring rod for rotating said cylindrical testing part, and a loading device having a torque measuring member connected to the top end of said boring rod for rotating said boring rod and for measuring the skin friction between said testing part and said wall of a bored hole in contact with said testing part, said main body having, at a lower end portion thereof, a cylindrical driving shoe for chipping the wall of a bored hole as said main body is advanced in said bored hole.

5. Apparatus as claimed in claim 4, wherein said cylindrical testing part has an outside diameter appreciably greater than the outside diameter of said main body.

6. Apparatus as claimed in claim 4, wherein said cylindrical testing part is mounted with a spacer disposed on at least one of its upper and lower sides.

7. Apparatus as claimed in claim 4, wherein a spring is mounted between said boring rod and a driving means therefore and the torque required for the rotation of said cylindrical testing part is determined by the displacement of said spring.

8. Apparatus as claimed in claim 7, wherein said driving means comprises a handle.

9. Apparatus as claimed in claim 4, wherein said cylindrical testing part is replaceable with a cylindrical testing part having a different surface roughness.

* * * * *